US005549279A

United States Patent [19]

Aszkenas

[11] Patent Number: 5,549,279

[45] Date of Patent: Aug. 27, 1996

[54] GUARD RAIL AND FENDER FORMED OF MOTOR VEHICLE TIRES

[76] Inventor: Marvin J. Aszkenas, 19195 Mystic Pointe Dr. Suite 1501, Aventura, Fla. 33180

[21] Appl. No.: 559,131

[22] Filed: Nov. 17, 1995

Related U.S. Application Data

[63] Continuation-in-part of Ser. No. 281,478, Jul. 27, 1994, abandoned.

[51] Int. Cl.[6] ..... E01F 13/00

[52] U.S. Cl. ..... 256/13.1; 256/1; 404/6

[58] Field of Search ..... 256/13.1, 1; 404/10, 404/13, 6

[56] References Cited

U.S. PATENT DOCUMENTS

| | | | |
|---|---|---|---|
| 3,165,305 | 1/1965 | Pfleger | 267/140 |
| 3,292,909 | 12/1966 | Bianchi | 256/13.1 |
| 3,338,206 | 8/1967 | Motter | 114/219 |
| 3,447,786 | 6/1969 | Bigni | 256/13.1 |
| 3,478,714 | 11/1969 | Keats | 404/10 X |
| 3,602,109 | 8/1971 | Harrington | 404/10 X |
| 3,848,853 | 11/1974 | Way et al. | 256/1 |
| 3,934,540 | 1/1976 | Bruner et al. | 116/63 P |
| 3,951,384 | 4/1976 | Hildreth, Jr. | 256/1 |
| 4,022,434 | 5/1977 | Moore | 256/1 |
| 4,109,474 | 8/1978 | Files et al. | 256/1 X |
| 4,186,913 | 2/1980 | Bruner et al. | 256/13.1 |
| 4,188,153 | 2/1980 | Taylor | 405/34 |
| 5,069,579 | 12/1991 | Burns | 405/25 |
| 5,372,451 | 12/1994 | Stewart | 404/6 |

FOREIGN PATENT DOCUMENTS

| | | | |
|---|---|---|---|
| 1232294 | 10/1960 | France | 404/10 |
| 2436375 | 2/1976 | Germany | 404/10 |
| 3639745 | 6/1988 | Germany | 404/6 |
| 561800 | 4/1957 | Italy | 404/10 |
| 92/11416 | 7/1992 | WIPO | 404/10 |

*Primary Examiner*—Dave W. Arola
*Assistant Examiner*—Christopher J. Novosad
*Attorney, Agent, or Firm*—Herbert L. Lerner; Laurence A. Greenberg

[57] ABSTRACT

A contiguous wall of mutually parallel, adjacent stacks of used motor vehicle tires defines a guard rail or dock fender. The device includes a frame which resembles a U lying on its side. Spindles extend between the legs of the U and the spindles extend through the hub openings of a stack of tires. The stacks of tires are rotatable relative to the frame, so as to absorb force components acting parallel to the wall of tires.

5 Claims, 2 Drawing Sheets

GUARD RAIL AND FENDER FORMED OF MOTOR VEHICLE TIRES

CROSS-REFERENCE TO RELATED APPLICATION

This is a continuation-in-part of my application Ser. No. 08/281,478 filed Jul. 27, 1994, now abandoned.

BACKGROUND OF THE INVENTION

1. Field of the Invention

The invention relates to guard rails for streets, intersections, major highways, dangerous curves, and to dock fenders at loading and marine docks, as well as to a system for disposing of discarded motor vehicle rubber tires.

2. Description of the Related Art

Tire disposal has long been a very serious environmental problem. Due to the fact that tire rubber degrades only negligibly in biologically balanced environments, old tires are usually stored in large landfills or they are utilized in barriers and the like.

Various uses have been heretofore proposed. For instance, beach erosion barriers as described in U.S. Pat. No. 5,069,579 to Burns make use of sections cut from tires and anchored into concrete blocks. Another breakwater barrier, which is also utilized as a highway safety barrier, is disclosed in U.S. Pat. Nos. 3,934,540 and 4,186,913 to Bruner et al. Elastic impact absorbing devices formed of stacks of tires are known from U.S. Pat. Nos. 3,951,384 to Hildreth, Jr. and 3,848,853 to Way et al.

Dock bumbers which may utilize old tires cut into strips are disclosed in U.S. Pat. Nos. 3,338,206 to Motter and 3,165,305 to Pfleger.

All of the above devices have in common that they are either virtually stiff upon perpendicular impact or that they do not give in a parallel direction, relative to the barrier wall formed thereby. In other words, at most impact force components which are oriented perpendicularly to the barrier are absorbed. Force components parallel to the wall are not absorbed.

SUMMARY OF THE INVENTION

It is accordingly an object of the invention to provide a guard rail and fender formed of motor vehicle tires, which overcomes the hereinafore-mentioned disadvantages of the heretofore-known devices of this general type and which makes it possible to absorb forces oriented parallel to the wall formed by the rail or fender.

With the foregoing and other objects in view there is provided, in accordance with the invention, a guard rail and fender device, comprising: a frame having a base; a plurality of substantially cylindrical spindles vertically supported on the base; and a plurality of stacks of motor vehicle tires, each of the stacks being formed by a plurality of tires mutually coaxially disposed on a respective spindle; the tires having a given diameter and being rotatable relative to the frame; and the spindles being mutually spaced apart by a distance substantially corresponding to the given diameter of the tires.

The tires, therefore, can absorb not only radial forces directed towards the hub center, but also tangential forces, by transforming them into rotation of the tires.

In accordance with an added feature of the invention, the frame further comprises a top rigidly connected with the base, the spindle extending between the base and the top and being attached to the top.

In accordance with an additional feature of the invention, the spindle is a plurality of spindles supported on the base of the frame at mutually spaced-apart locations, and the stack is a plurality of stacks, each of the plurality of spindles having a respective one of the plurality of stacks disposed thereon, the plurality of stacks forming a wall bumper for absorbing force components acting on the tires in a direction parallel to a line connecting the plurality of spindles by transforming the force components into a rotation of the tires.

In accordance with a further feature of the invention, the spindle is rotatable relative to the base. In accordance with a concomitant feature of the invention, the spindle is non-rotatably supported on the base and the stack of tires is rotatable relative to the spindle.

It should be understood that it is possible to provide the tires rotatable relative to a fixed spindle, the tires fixed on a rotatable spindle, or a combination thereof. The important feature is that the tires are allowed to rotate relative to the stationary frame upon tangential force impact thereon.

Other features which are considered as characteristic for the invention are set forth in the appended claims.

Although the invention is illustrated and described herein as embodied in a guard rail and fender formed of motor vehicle tires, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
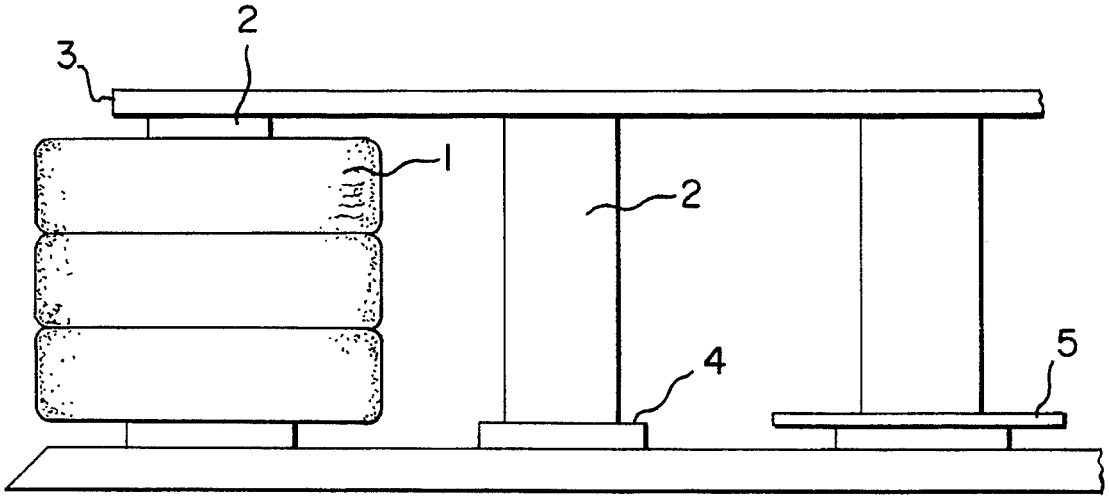
FIG. 1 is a partial, side-elevational view of a guard rail according to the invention.

Referring now to the figures of the drawing in detail and first, particularly, to FIG. 1 thereof, there is seen a portion of a partially assembled guard rail. A stack of three tires 1 are rotatably stacked on a spindle 2. The spindle 2 is rigidly attached to a frame 3.

Figure 2:
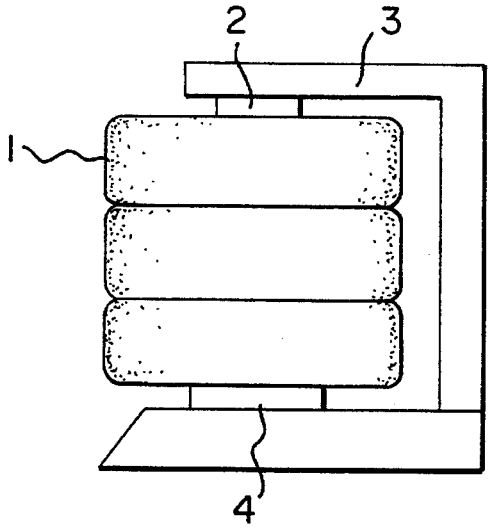
FIG. 2 is a side-elevational view of a guard rail.
Figure 3:
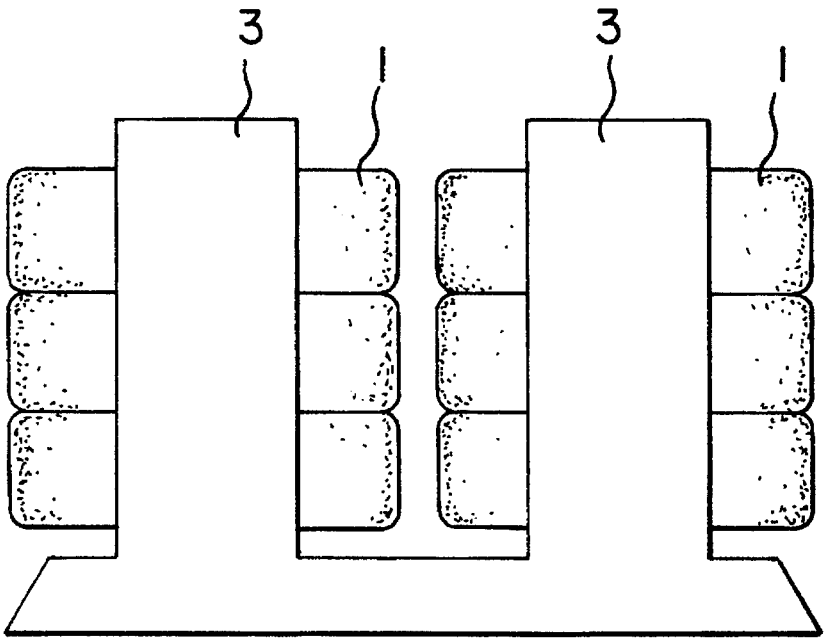
FIG. 3 is a rear-elevational view of a two-stack embodiment thereof.
Figure 4:
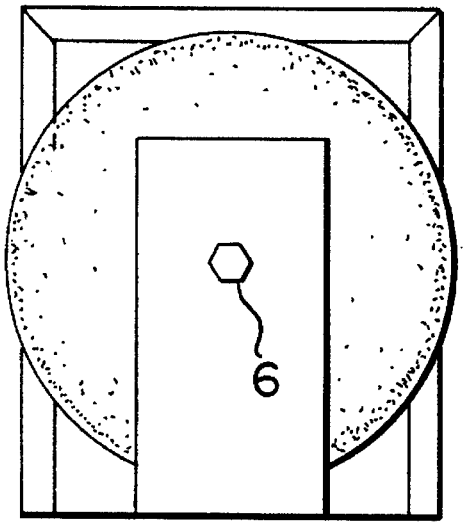
FIG. 4 is a top-plan view of a single-stack embodiment thereof.

The frame, if the device is used as a guard rail, is rigidly mounted on the side of the street as conventionally done with guard rail structures. If used as a dock fender, the back of the frame is attached to the dock wall. Also, the base of the frame is shortened relative to the illustration of FIGS. 2 and 4, such that the stack of tires 1 projects well out of the frame 3.

The spindle 2 is provided with a lower ledge 4 on which the lowermost tire is supported. The purpose of the ledge is to completely support the tires 1, yet only offer as little friction as possible.

The spindles 2 are mutually spaced apart by a distance which substantially corresponds to the diameter of the tires. When the tire stacks are placed on the spindles, the resulting structure is a contiguous wall structure of immediately adjacent stacks of tires. In the preferred embodiment, the tread surfaces of the tires of mutually adjacent stacks are spaced apart by approximately 1–10 cm (½-3 inches), so as to allow for independent rotation thereof and to allow for tolerances in the tire diameters.

The diameter of the substantially cylindrical spindle 2 corresponds to the hub opening of the tires 1. For the purpose of providing a universally fitting device, it is also proposed to provide sleeves which slip over the spindle 2. In that case, the spindle diameter corresponds to the smallest hub diameter and each cylindrical sleeve widens the diameter by one hub size. The sleeve may be provided for the entire spindle 2, i.e. for the full stack of tires, or only for individual tires.

In alternative embodiments, the spindle 2 is rotatably supported in the frame 3 and/or a washer 5 is placed on the ledge 4, which reduces friction between the tires and their vertical support.

It should be understood that the frame 3 and the spindle 2 may be made of concrete, of recycled plastics, of metal, or of any combination thereof. If the spindle 2 is formed of metal, it is preferably a hollow tube which is filled with particulate matter, such as sand. The tires are filled with similar material, such as sand, concrete, clay, etc.

The spindle 2 may be attached with a center axle 6 which extends between the base and the top of the frame 3.

I claim:

1. A guard rail and fender device, comprising:

a frame having a base;

a plurality of substantially cylindrical spindles vertically supported on said base; and a plurality of stacks of motor vehicle tires, each of said stacks being formed by a plurality of tires mutually coaxially disposed on a respective spindle; said tires having a given diameter and being rotatable relative to said frame; and said spindles being mutually spaced apart by a distance substantially corresponding to said given diameter of said tires.

2. The device according to claim 1, wherein said frame further comprises a top rigidly connected with said base, said spindles extending between said base and said top and being attached to said top.

3. The device according to claim 1, wherein said plurality of stacks form a wall bumper for absorbing force components acting on said tires in a direction parallel to a line connecting said plurality of spindles by transforming the force components into a rotation of said tires.

4. The device according to claim 1, wherein said spindles are rotatable relative to said base.

5. The device according to claim 1, wherein said spindles are non-rotatably supported on said base and said stacks of tires are rotatable relative to each respective spindle.

* * * * *